US008213843B2

(12) United States Patent
Ohashi

(10) Patent No.: US 8,213,843 B2
(45) Date of Patent: Jul. 3, 2012

(54) DEVELOPING DEVICE HAVING TONER RECOVERY TRAY AND IMAGE FORMING APPARATUS

(75) Inventor: Hiroaki Ohashi, Osaka (JP)

(73) Assignee: Kyocera Mita Corporation (JP)

( * ) Notice: Subject to any disclaimer, the term of this patent is extended or adjusted under 35 U.S.C. 154(b) by 277 days.

(21) Appl. No.: 12/786,809

(22) Filed: May 25, 2010

(65) Prior Publication Data

US 2010/0303510 A1 Dec. 2, 2010

(30) Foreign Application Priority Data

May 29, 2009 (JP) ..... 2009-130577

(51) Int. Cl.
*G03G 15/09* (2006.01)

(52) U.S. Cl. ..... 399/273; 399/120; 399/360

(58) Field of Classification Search ..... 399/107, 399/111, 119, 120, 252, 258–263, 273, 358–360
See application file for complete search history.

(56) References Cited

U.S. PATENT DOCUMENTS

| | | | | |
|---|---|---|---|---|
| 6,628,910 | B2 * | 9/2003 | Tanisawa et al. | 399/120 |
| 7,890,022 | B2 * | 2/2011 | Kweon et al. | 399/120 |
| 7,995,961 | B2 * | 8/2011 | Ichiki et al. | 399/360 |
| 8,131,182 | B2 * | 3/2012 | Mizuno et al. | 399/120 |

FOREIGN PATENT DOCUMENTS

JP 2009-036798 2/2009

* cited by examiner

*Primary Examiner* — Hoan Tran
(74) *Attorney, Agent, or Firm* — Gerald E. Hespos; Michael J. Porco

(57) ABSTRACT

A developing device includes: a developing housing having a developer accommodating chamber; a developer bearing member which is supported rotatably inside a developing housing, and which holds on a circumferential surface thereof a two-component developer composed of a magnetic carrier and toner; a toner bearing member which is supported rotatably with respect to the developer bearing member inside the developing housing, and to which the toner in the developer held on the developer bearing member adheres electrostatically; and a toner recovery tray which has an opening in an upper end thereof, and which is installed removably in the developing housing below the developer bearing member and the toner bearing member.

20 Claims, 12 Drawing Sheets

DEVELOPING DEVICE HAVING TONER RECOVERY TRAY AND IMAGE FORMING APPARATUS

BACKGROUND OF THE INVENTION

1. Field of the Invention

The present invention relates to a developing device provided in an image forming apparatus such as an electrostatic copying machine, printer, facsimile machine, or a composite of these, and to an image forming apparatus having the developing device.

2. Description of the Related Art

There is known a developing device in which a magnetic roller (developer bearing member) which holds and conveys a two-component developer consisting of a magnetic carrier and a non-magnetic toner on a circumferential surface of the roller, and a developing roller (toner bearing member) which is disposed so as to oppose the magnetic roller, are supported rotatably inside a developing housing having a developer accommodating chamber. In this developing device, toner in a developer which has been supplied from the developer accommodating chamber and is held on the magnetic roller adheres electrostatically to the developing roller.

In this developing device, the magnetic roller is disposed obliquely below and to the right of the developing roller. The developer accommodating chamber includes a pair of agitating and conveying members which are disposed in parallel fashion in the lateral direction, at positions vertically below the positions where the developing roller and the magnetic roller are disposed (positions included in the downward projected regions of the rollers). Furthermore, a recovery roller is disposed so as to make contact with the lower end portion of the surface of the developing roller.

In the developing device described above, undeveloped toner (residual toner) which is remaining on the surface of the developing roller is scraped off and recovered by means of the recovery roller. On the other hand, toner (residual toner) which has not been supplied from the magnetic roller to the developing roller drops down naturally into the separating magnetic pole region of the magnetic roller and is recovered into the developer accommodating chamber. Furthermore, dispersed toner also drops down inside the developer accommodating chamber and is thereby recovered.

However, due to the layout of the developing device, there are cases where the developer accommodating chamber is not disposed in a position vertically below the positions where the magnetic roller and the developing roller are disposed, but rather is disposed in a position shifted in the lateral direction or in an upper position, or the like. In this case, it becomes difficult to recover residual toner from the developing roller and the magnetic roller, or to dispersed toner.

SUMMARY OF THE INVENTION

The object of the present invention is to provide a developing device, and an image forming apparatus including the developing device, whereby dispersed toner from the developing roller, the magnetic roller, and the like, can be recovered regardless of the layout of the developer accommodating chamber.

The developing device relating to one aspect of the present invention which achieves this object includes: a developing housing having a developer accommodating chamber; a developer bearing member which is supported rotatably inside the developing housing, and which holds, on a circumferential surface thereof, a two-component developer composed of a magnetic carrier and toner; a toner bearing member which is supported rotatably so as to oppose the developer bearing member inside the developing housing, and to which the toner in the developer held on the developer bearing member adheres electrostatically; and a toner recovery tray which has an opening in an upper end thereof, and which is installed removably in the developing housing below the developer bearing member and the toner bearing member.

Furthermore, the image forming apparatus relating to a further aspect of the present invention is an image forming apparatus including: an image bearing member; and a developing device which supplies toner to the image bearing member; wherein the developing device has the composition described above.

DETAILED DESCRIPTION OF THE PREFERRED EMBODIMENTS

Below, a developing device and an image forming apparatus including the developing device relating to the present embodiment are described in detail with reference to the accompanying drawings. Firstly, a tandem type color image forming apparatus 100, which is one example of an image forming apparatus including a developing device, will be described with reference to FIG. 12. The actual composition of a tandem type color image forming apparatus, apart from the developing device, may be a commonly known composition.

In the present embodiment, the tandem type color image forming apparatus 100 is a composite machine including a printer and a facsimile machine. The image forming apparatus 100 includes an apparatus main body 102 which has a substantially square shape. An automatic original document conveyance apparatus 104 is disposed on the uppermost end of the apparatus main body 102, and an image reading apparatus 106 including an exposure scanning mechanism (not illustrated) is provided below the automatic original document conveyance apparatus 104.

Figure 12:
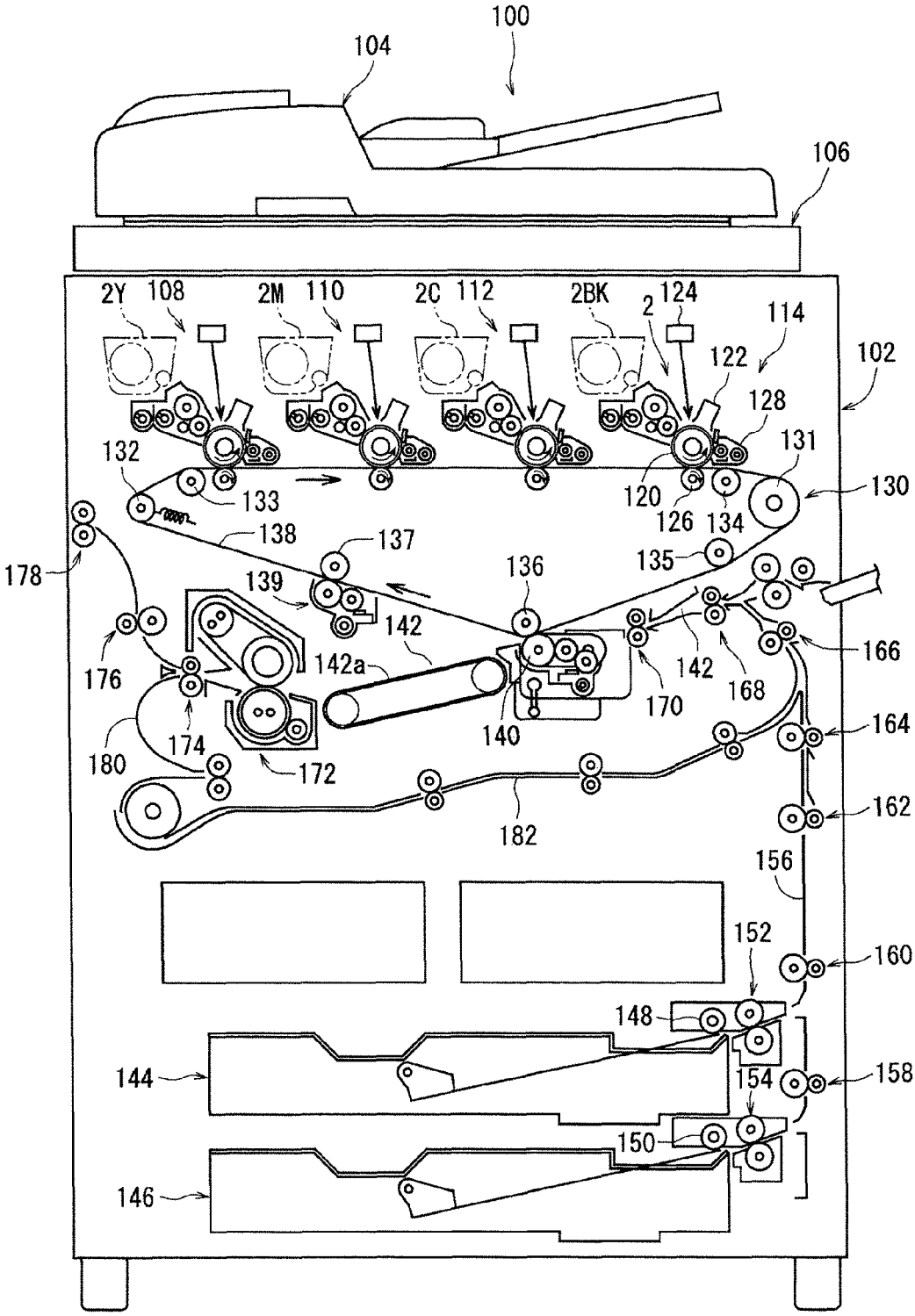
FIG. 12 is a schematic cross-sectional diagram showing a composition of a tandem type color image forming apparatus including a developing device relating to the present embodiment.

A yellow process unit 108, a magenta process unit 110, a cyan process unit 112 and a black process unit 114 are provided in this sequence from left to right in FIG. 12, inside the apparatus main body 102. These process units 108, 110, 112 and 114 each respectively include imaging elements, such as a photosensitive drum 120 (image bearing member), a charging device 122, an LED head 124, a developing device 2 (described hereinafter), a primary transfer roller 126, a cleaning apparatus 128, and the like. In FIG. 12, in order to simplify the drawings, the reference numbers of the imaging elements are labelled only in respect of the black process unit 114. In the embodiment, these process units 108, 110, 112 and 114 are disposed in parallel in the stated order, in substantially horizontal fashion, from left to right in FIG. 12.

Toner replenishment containers 2Y, 2M, 2C and 2BK for replenishing toners of corresponding colors are provided respectively to each developing device 2 of the process units 108, 110, 112 and 114 (in FIG. 12, these are depicted respectively by double-dotted lines). An intermediate transfer belt mechanism 130 is disposed below the process units 108, 110, 112 and 114. The intermediate transfer belt mechanism 130 includes a drive roller 131, a plurality of idle rollers 132, 133, 134, 135, 136 and 137, and an intermediate transfer belt 138 wrapped about these rollers. A cleaning apparatus 139 for cleaning the intermediate transfer belt 138 is disposed in a position corresponding to the idle roller 137 of the intermediate transfer belt mechanism 130.

In the respective process units 108, 110, 112 and 114, a primary transfer roller 126 is pressed and abutted against the photosensitive drum 120 from below via the upper end travelling region of the intermediate transfer belt 138. A secondary transfer roller 140 is disposed below the idle roller 136, and the secondary transfer roller 140 is pressed from below against the idle roller 136 via the intermediate transfer belt 138. Since the drive roller 131 is driven to rotate in the clockwise direction in FIG. 12, then the intermediate transfer belt 138 and the respective idle rollers 132 to 137 are also driven in the clockwise direction.

A conveyance path 142 for conveying paper, which is an image recording medium, extends in a substantially horizontal direction in FIG. 12, below the intermediate transfer belt mechanism 130. A portion of the conveyance path 142 is constituted by a conveyance belt 142*a*. The nip portion between the secondary transfer roller 140 and the idle roller 136 is disposed at an intermediate position of the conveyance path 142.

Two paper supply cassettes 144 and 146 are disposed in parallel upper and lower positions, below the conveyance path 142. Pick-up rollers 148 and 150 are provided respectively directly above the right end portions of the paper supply cassettes 144 and 146 in FIG. 12. Pairs of separating rollers 152 and 154 are provided respectively to the downstream side of the pick-up rollers 148 and 150. The downstream side of the separating roller pairs 152 and 154 is connected to a conveyance path 156 which extends in the vertical direction. The upper end portion of the conveyance path 156 is curved and connected to the conveyance path 142. A plurality of conveyance roller pairs 158, 160, 162, 164 and 166 are disposed in the conveyance path 156.

A conveyance roller pair 168 and a resist roller pair 170 are disposed in this sequence from the upstream side toward the downstream side, in the conveyance path 142 on the downstream side of the conveyance roller pair 166, to the upstream side of the secondary transfer roller 140. The fixing apparatus 172 and the conveyance roller pair 174 are disposed in this sequence, in the downstream direction, further downstream of the conveyance path 142 than the secondary transfer roller 140. The portion of the conveyance path 142 on the downstream side of the conveyance roller pair 174 curves upwards and leads to a paper discharge port formed in the left side wall, in FIG. 12, of the apparatus main body 102, and a conveyance roller pair 176 and a discharge roller pair 178 are provided in this sequence in the downstream direction, in this portion of the conveyance path 142.

Below the conveyance path 142, there are provided a reverse conveyance path 180 which branches from the conveyance roller pair 174 and reverses direction, and a paper re-supply conveyance path 182 which reverses again from the reverse conveyance path 180 and extends rightwards in FIG. 12 below the conveyance path 142. The paper re-supply conveyance path 182 converges with the conveyance path 156 in the portion thereof between the conveyance roller pair 164 and the conveyance roller pair 166. The reverse conveyance path 180 and the paper re-supply conveyance path 182 are used when forming toner images on both surfaces of the paper.

In the image forming apparatus 100 described above, the actual printing operation and duplicating operation are carried out in a commonly known fashion, and therefore are only described briefly here. For example, when a printing operation is carried out, in each of the process units 108, 110, 112 and 114, the surface of the photosensitive drum 120 which has been charged uniformly by a respective charging device 122 is exposed by an LED head 124, thereby forming an electrostatic latent image. This electrostatic latent image is developed by the developing device 2 described below to create a toner image. The respective toner images are each transferred by a primary transfer roller 126 onto the intermediate transfer belt 138 of the intermediate transfer belt mechanism 130, so as to be mutually superimposed in sequence starting from the toner image formed by the process unit 108 on the upstream side.

The color toner image which has been transferred to the intermediate transfer belt 138 is transferred to one surface of paper supplied from a paper supply cassette 144, for example, while the paper is passed through a nip section between the idle roller 136 and the secondary transfer roller 140. This toner image is fixed by heat to the paper while passing through the fixing apparatus 172. The paper on which the toner image has been heat fixed is discharged to a discharge tray (not illustrated) by passing through conveyance roller pairs 174 and 176 and discharge roller pair 178. The printing operation whereby a toner image is formed on both surfaces of the paper is not described here.

Figure 1B:
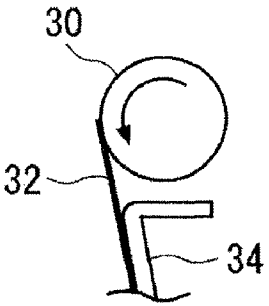
FIG. 1A is a cross-sectional diagram of a developing device relating to the present embodiment and FIG. 1B is a general schematic drawing showing an enlarged view of a portion of FIG. 1A.
Figure 1A:
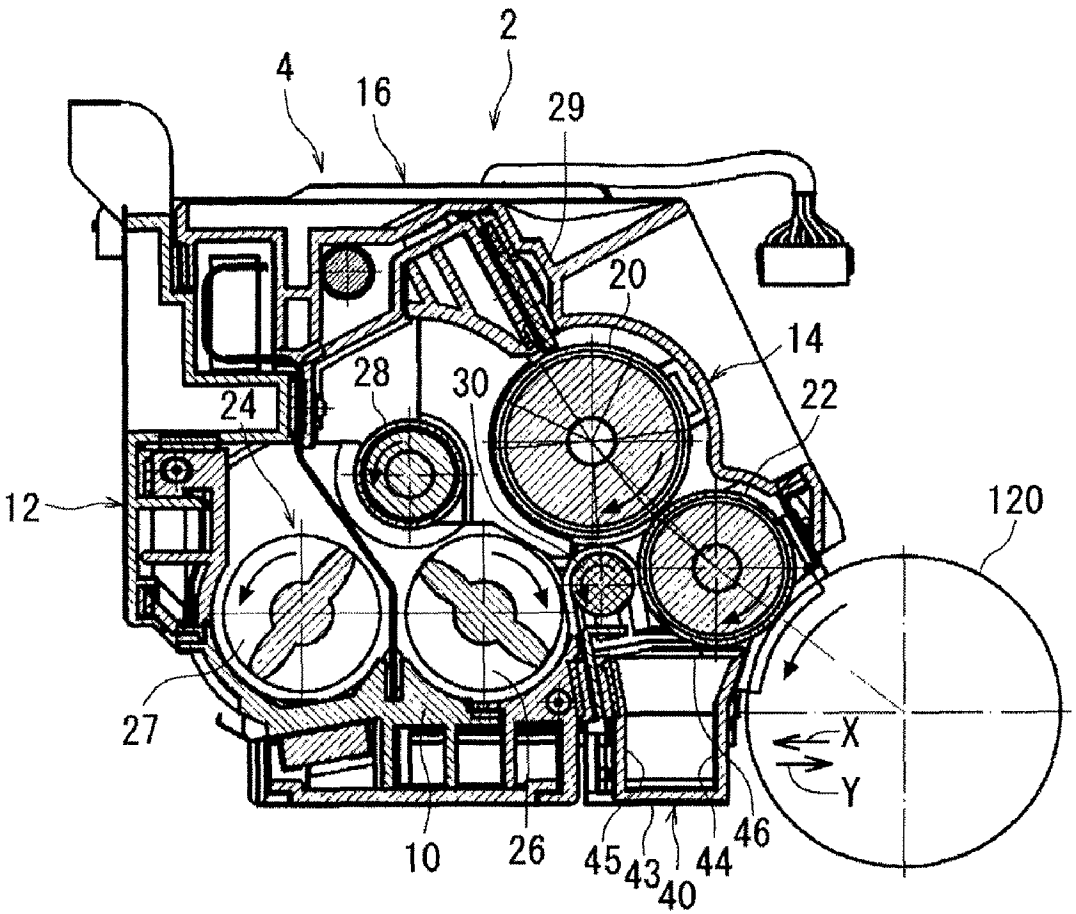
Figure 2:
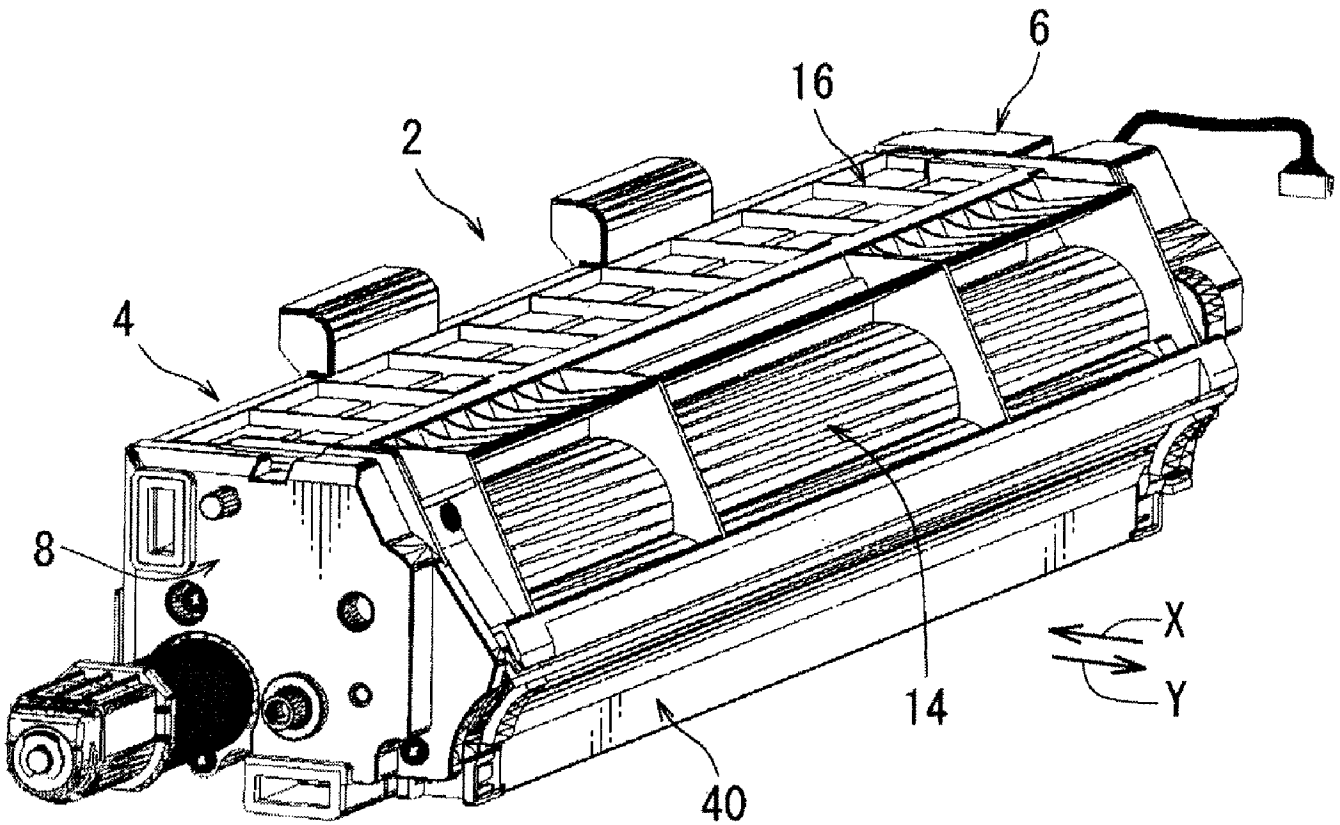
FIG. 2 is a perspective diagram of the developing device shown in FIG. 1A.
Figure 3:
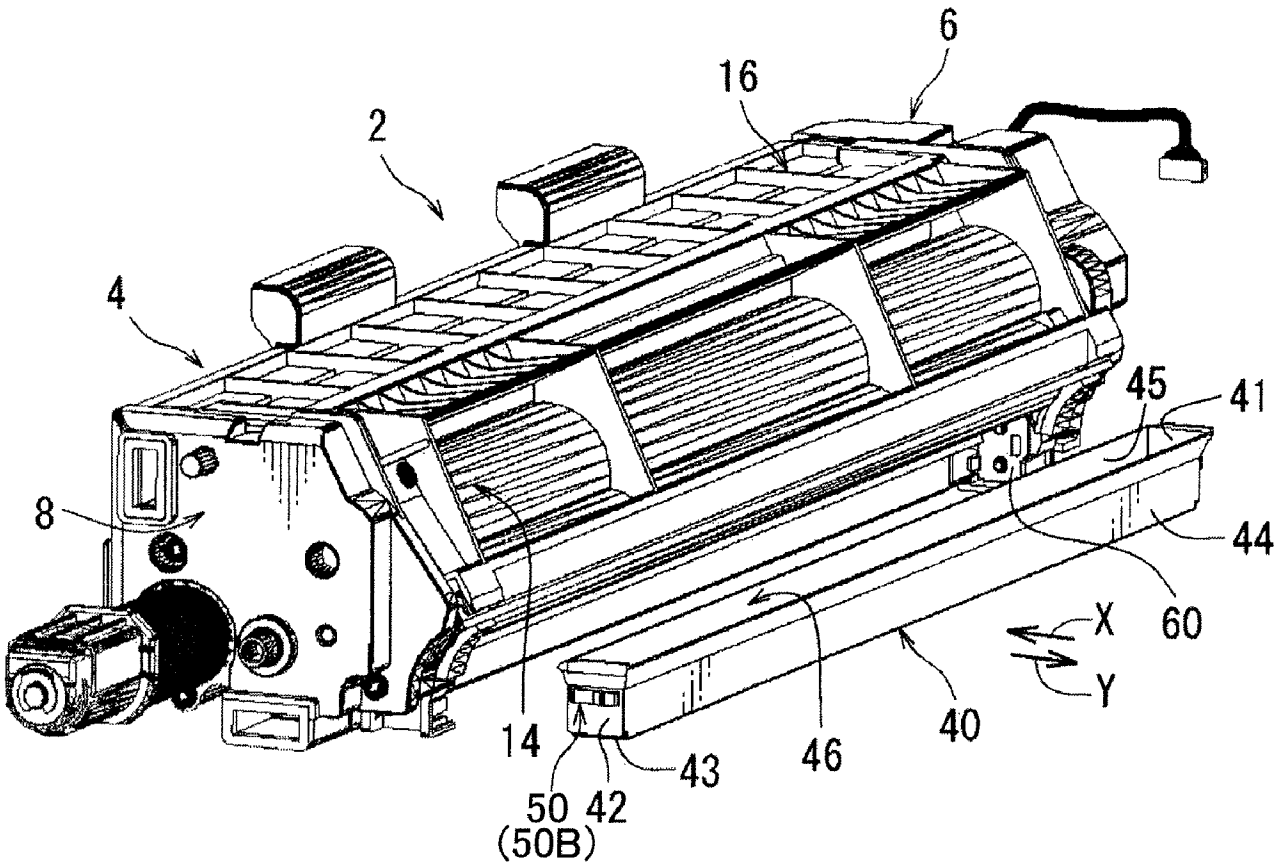
FIG. 3 is a perspective diagram showing a state where the toner recovery tray has been removed from the developing device in FIG. 2.

Next the developing device 2 relating to the present embodiment will be described in detail. Referring to FIGS. 1A and 1B and FIG. 2, the developing device 2 includes a developing housing 4 which is composed by assembling a plurality of members formed from a suitable synthetic resin. The developing housing 4 includes a first side wall 6, a second side wall 8, a bottom wall 10, a rear wall 12, a front wall 14 and a ceiling face 16, which are disposed at intervals in the lengthwise direction (the direction perpendicular to the plane of the drawings in FIG. 1A).

A magnetic roller 20 and a developing roller 22 are provided inside the developing housing 4. The magnetic roller 20 and the developing roller 22 are supported rotatably by the first side wall 6 and the second side wall 8, so as to lie respectively parallel and be mutually opposing via a prescribed gap. The developing roller 22 is disposed in the fourth quadrant of virtual coordinates axes (not illustrated) having a horizontal axis and a vertical axis which pass through the axis center of the magnetic roller 20, in FIG. 1A. The magnetic roller 20 is a developer bearing member which holds and conveys, on the circumferential surface thereof, a two-component developer including a magnetic carrier and a non-magnetic toner. The developing roller 22 is a toner bearing member, to the surface of which the toner in the developer held and conveyed by the magnetic roller 20 adheres electrostatically.

The developer accommodating chamber 24 which accommodates a two-component developer is disposed inside the developing housing 4. In the virtual coordinates axes in FIG. 1A, the developer accommodating chamber 24 is disposed in the third quadrant. Two developer agitating and conveying members 26 and 27 are disposed in the developer accommodating chamber 24, in parallel in a horizontal direction in FIG. 1A. The developer agitating and conveying members 26 and 27 have a spiral blade extending in the axial direction and agitating blades extending in the radial direction, and are supported rotatably between the first side wall 6 and the second side wall 8. The developer accommodated inside the developer accommodating chamber 24 is conveyed and circulated while being agitated in respectively opposite directions in the lengthwise direction of the developing housing 4, by the developer agitating and conveying members 26 and 27. By this means, the toner contained in the developer is charged to a prescribed level and is attracted to and held on the carrier.

A developer uptake roller 28 is provided in a horizontal lateral direction at a position directly above substantially the center position of the developer agitating and conveying members 26 and 27. The developer uptake roller 28 is also supported rotatably between the first side wall 6 and the second side wall 8. The developer uptake roller 28 is accommodated inside the developer accommodating chamber 24 and developer agitated and conveyed by the developer agitating and conveying members 26 and 27 is supplied to the magnetic roller 20. One portion of the upper end of the developer uptake roller 28 is disposed in the second quadrant in the virtual coordinates axes in FIG. 1A, and the remaining lower portion is disposed in the third quadrant.

A restricting member 29 is provided inside the developing housing 4 in such a manner that the front end thereof opposes the surface of the magnetic roller 20. The restricting member 29 sets the developer supplied to the surface of the magnetic roller 20 from the developer uptake roller 28 to a uniform layer thickness.

A toner recovery roller 30 (recovery member) is provided in the developing housing 4 so as to oppose the magnetic roller 20 and the developing roller 22 via a gap. In the present embodiment, the toner recovery roller 30 is disposed below the magnetic roller 20 in a space between the developer agitating and conveying member disposed in the developer accommodating chamber 24 and the developing roller 22, and is supported rotatably between the first side wall 6 and the second side wall 8. Toner can adhere electrostatically to the circumferential surface of the toner recovery roller 30.

One portion of the toner recovery roller 30 in the horizontal lateral direction is disposed in the third quadrant in the virtual coordinates axes in FIG. 1A, and the other portion in the horizontal lateral direction is disposed in the fourth quadrant. As shown in enlarged fashion in FIG. 1B, the tip of a blade member 32 (introducing member) for scraping away (guiding) toner adhering electrostatically to the toner recovery roller 30, so that the toner falls down into the developer accommodating chamber 24, is made to contact the toner recovery roller 30. A blade member 32 composed of a film made of a suitable synthetic resin is fixed to a supporting plate 34 fixed inside the developing housing 4.

As indicated by the respective arrows in FIG. 1A, the magnetic roller 20 and the developing roller 22 are driven to rotate in a clockwise direction, and rotate relatively in mutually opposite directions in the region where they oppose each other. The developer uptake roller 28 and the toner recovery roller 30 are both driven to rotate in the counter-clockwise direction. The developer agitating and conveying member 26 is driven to rotate in the clockwise direction and the developer agitating and conveying member 27 is driven to rotate in the counter-clockwise direction, and hence the members rotate relatively in the same upward direction in the region where they oppose each other.

By means of this composition, the developer which is agitated and conveyed by the developer agitating and conveying members 26 and 27 is raised up toward the developer uptake roller in the region where the developer agitating and conveying members 26 and 27 oppose each other. The axes of the magnetic roller 20, the developing roller 22, the developer agitating and conveying members 26 and 27, the developer uptake roller 28 and the toner recovery roller 30 are disposed so as to extend mutually in parallel in the lengthwise direction of the developing housing 4.

As shown in FIG. 1A, the lower end of the front wall 14 of the developing housing 4 is positioned in the vicinity of the middle portion, in terms of the vertical direction, of the right-hand end (front end) of the developing roller 22. The right-hand end of the bottom wall 10 is positioned below the toner recovery roller 30, in the vicinity of the boundary between the third quadrant and the fourth quadrant of the virtual coordinates axes. By adopting a composition of this kind, a space which is open on the right-hand side (front side) and the lower side in FIG. 1A is formed between the lower end of the front wall 14, the right-hand end (front end) of the bottom wall 10, the first side wall 6 and the second side wall 8 in the developing housing 4. Substantially the lower semicircular region of the surface of the developing roller 22 is exposed to the right side (front side) and lower side.

The toner recovery tray 40 is installed detachably in the aforementioned space of the developing housing 4, in other words, below the magnetic roller 20 and the developing roller 22, with the upper end opening 46 of the tray (described hereinafter) facing towards the magnetic roller 20 and the developing roller 22. When the toner recovery tray 40 is installed in the developing housing 4, the toner recovery roller 30 is positioned above the opening 46 of the toner recovery tray 40.

Referring to FIG. 1A to FIG. 3, the toner recovery tray which is formed integrally from a suitable synthetic resin, includes a first end wall 41 and a second end wall 42 which are mutually opposing via an interval in the lengthwise direction (the axial direction of the magnetic roller 20 and the developing roller 22), a bottom wall 43 which extends between the first end wall 41 and the second end wall 42, and a front side wall 44 and a rear side wall 45 which extend upwards from the respective sides of the bottom wall 43 and the respective ends of which in the lengthwise direction are connected to the respective sides of the corresponding first end wall 41 and the second end wall 42. As described in detail hereinafter, when the toner recovery tray 40 has been installed in the developing housing 4, the first end wall 41 of the toner recovery tray 40 engages with the first side wall 6 of the developing housing, and the second end wall 42 engages respectively with the second side wall 8.

An opening 46 of the toner recovery tray 40 is formed in the upper end of the narrow rectangular shape extending in the lengthwise direction which is enclosed by the first end wall 41, the second end wall 42, the front side wall 44 and the rear side wall 45. As shown in the respective ends depicted in FIG. 4 and FIG. 5, the bottom surface 43A of the bottom wall 43 in either end portion in the lengthwise direction is formed so as to be located, via a step section 47, at a higher position than the bottom surface 43B of the bottom wall 43 in the intermediate portion in the lengthwise direction. The respective bottom surfaces 43A in the end portions are positioned in the same plane.

As shown respectively in partial fashion in FIG. 3, FIG. 4, FIG. 5 and FIG. 7, a first elastic engagement receiving hook 50 (50A) is formed integrally with the outer surface of the first end face 41 of the toner recovery tray 40. A second elastic engagement receiving hook 50 (50B) is formed integrally with the outer surface of the second end face 42, in a similar fashion. The first and second elastic engagement receiving hooks 50 (50A, 50B) have differences in terms of their left/right composition, but essentially have the same shape and size. Below, the first elastic engagement receiving hook 50A (elastic engagement receiving hook 50) which is formed on the first end face 41 will be described.

The elastic engagement receiving hook 50 has a base end section 51 which extends outwards from the outer surface of the first end face 41, a main body section 52 which extends from the front end of the base end section 51 in the removal direction Y of the toner recovery tray 40 with respect to the developing housing 4 (the direction indicated by arrow Y in FIG. 1A and FIG. 2 to FIG. 7, in other words, the reverse introduction direction Y), at an interval apart from the outer surface of the first end wall 41, and an engagement receiving section 53 which projects outwards from the outer surface of the main body section 52. The direction indicated by the arrow X in FIG. 1A and FIG. 2 to FIG. 7 is the installation direction X (in other words, the insertion direction X) of the toner recovery tray 40 with respect to the developing housing 4.

The base end section 51 and the main body section 52 are formed in a plate shape having a prescribed width in the height direction and a prescribed thickness. The base end section 51 extends outwards from the outer surface of the first end wall 41 and then curves in the detachment direction Y. The engagement receiving section 53 includes an engagement receiving surface 53A which extends perpendicularly outwards from the main body section 52 and an oblique surface 53B extending to the outer surface of the main body section 52 in the installation direction X from the front end of the engagement receiving surface 53A. The engagement receiving surface 53A extends to a prescribed height in the vertical direction perpendicular to the installation direction X, at a prescribed width in the horizontal direction which is perpendicular to the installation direction X (the lengthwise direction of the toner recovery tray 40). The main body section 52 is able to deform elastically about the fulcrum of the base end section 51, in a direction toward and away from the outer surface of the first end wall 41.

Referring to FIG. 1A, FIG. 3, FIG. 4, FIG. 6 and FIG. 7, as stated previously, a space which is open on the right-hand side (front side) and lower side in FIG. 1A is formed between the lower end of the front wall 14, the right-hand end (front end) of the bottom wall 10, the first side wall 6 and the second side wall 8 in the developing housing. The space is a space which is disposed below the magnetic roller 20 and the developing roller 22. The side wall 60 and a side wall (not illustrated), which are mutually opposing, are disposed in the developing housing 4 at an interval apart in the axial direction of the magnetic roller 20 and the developing roller 22, so as to sandwich this lower space in the lengthwise direction. The side wall 60 and the side wall which is not illustrated respectively constitute one portion of the first side wall 6 and the second side wall 8 of the developing housing 4.

Engaging holes 62 which constitute engaging sections are formed respectively in positions which relatively oppose the side wall 60 and the side wall which is not illustrated (only the engaging hole 62 formed in the side wall 60 is depicted). These engaging sections may also be engaging recess sections and engaging projections. The side wall 60 and the side wall (not illustrated) have a prescribed thickness in the lengthwise direction, but in the present embodiment, other members which constitute the first side wall 6 and the second side wall 8 are superimposed on the respective outer sides thereof, and therefore the outer side of the engaging hole 62 is closed off and effectively forms an engaging recess section. However, as can be seen readily from the following description, the engaging section has the same effective function, whether it is an engaging recess section or an engaging hole, or an engaging projection (not illustrated) which is described hereinafter, and therefore the description is continued with respect to an engaging hole 62.

In the side wall 60 and the side wall which is not illustrated, engaging holes 62 having substantially the same shape and size as each other are formed in a square shape when the developing housing 4 is viewed in the lengthwise direction. The engaging hole 62 has an engaging surface 62A which faces in the installation direction X of the toner recovery tray 40. The engaging surface 62A extends to a prescribed height in the vertical direction perpendicular to the installation direction X, at a prescribed width in the horizontal direction which is perpendicular to the installation direction X.

Figure 4:
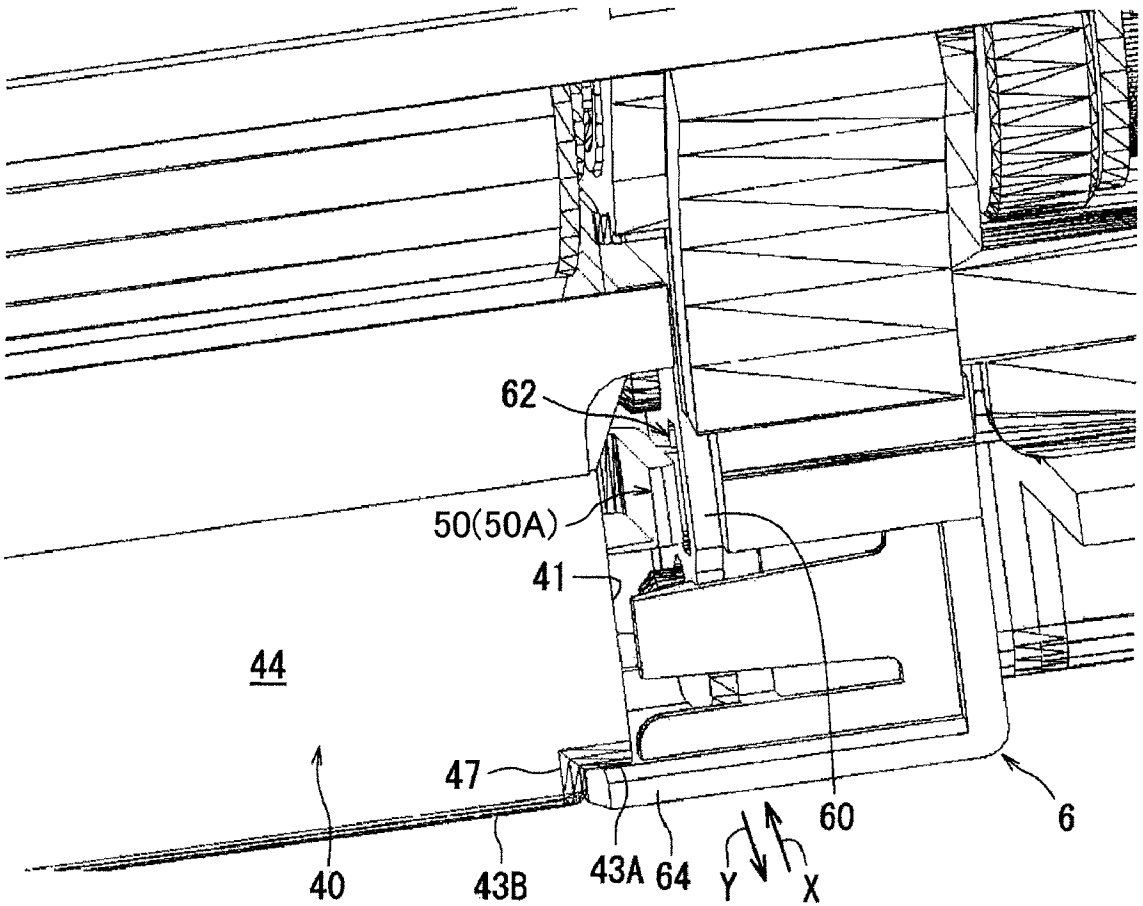
FIG. 4 is a perspective diagram showing an enlarged view of a portion of the right-hand end region of the developing device.
Figure 5:
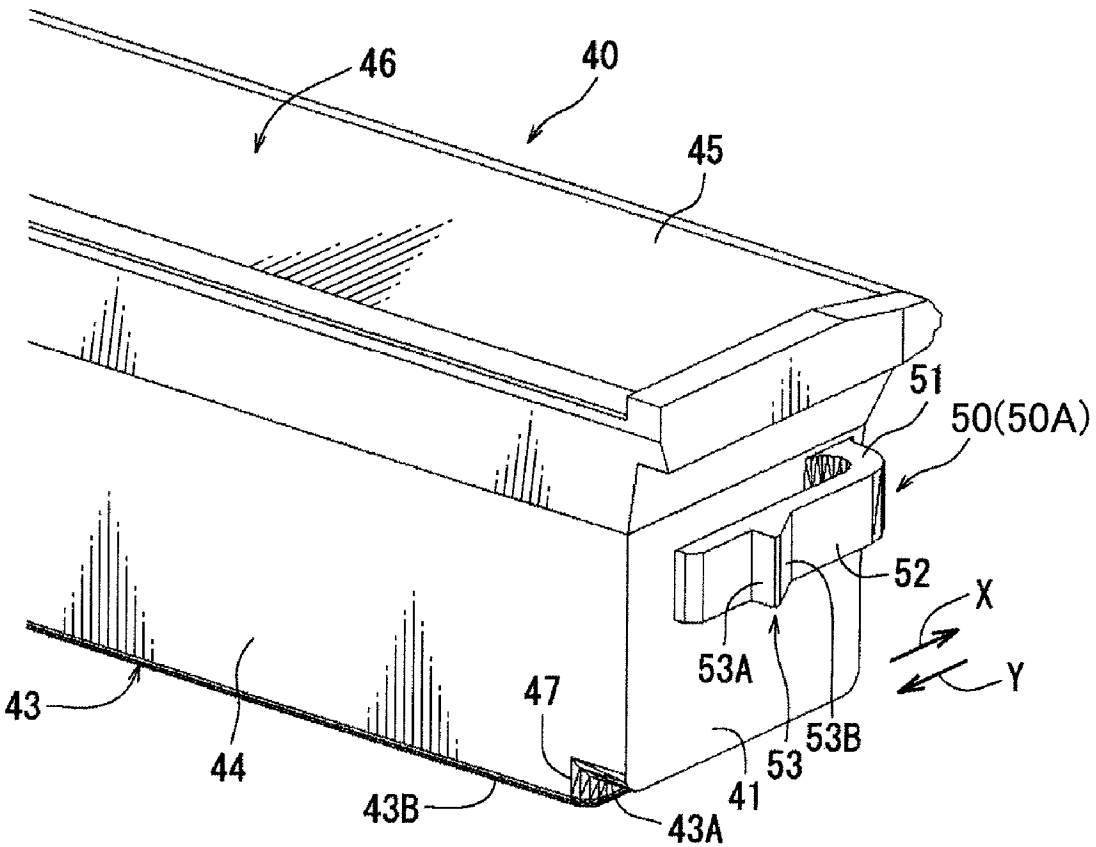
FIG. 5 is a partial enlarged perspective diagram of the toner recovery tray shown in FIG. 3, as viewed from the right-hand and rear side.
Figure 6:
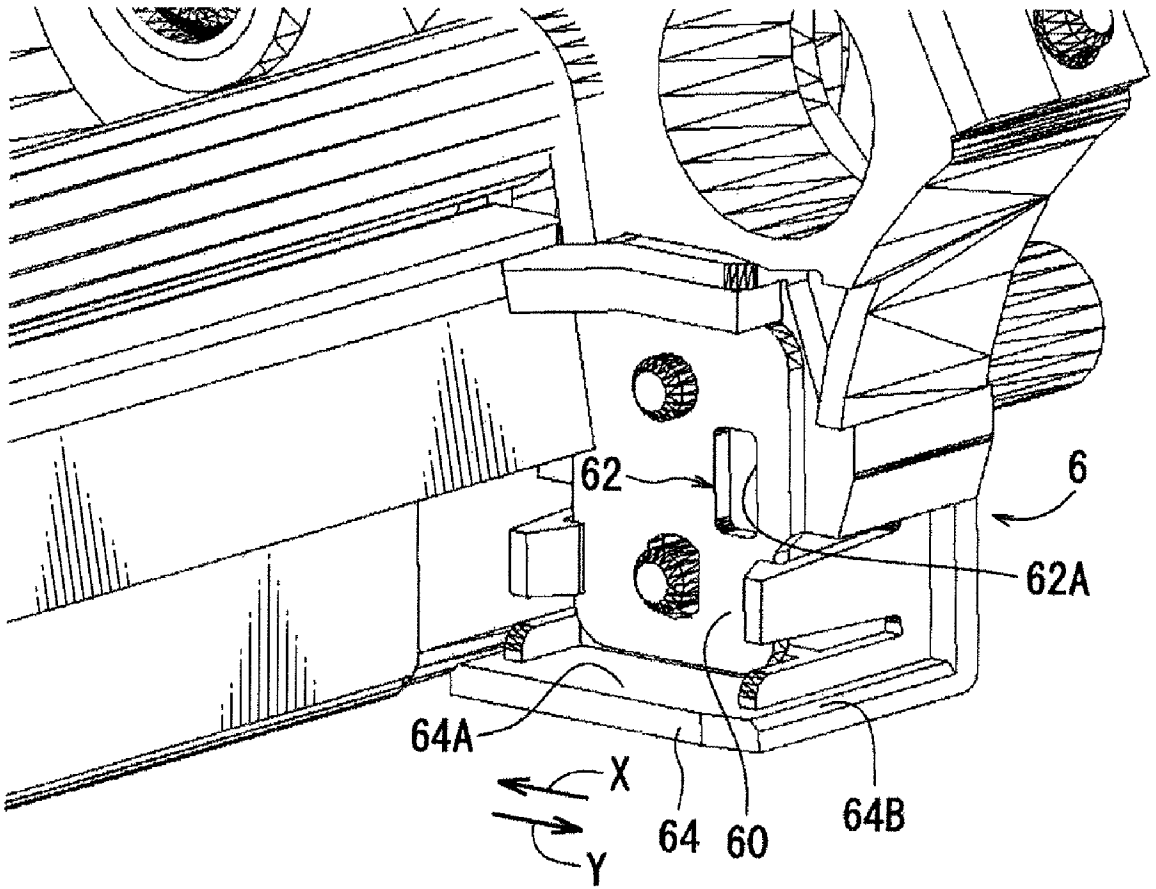
FIG. 6 is a perspective diagram showing a state where the toner recovery tray has been removed in FIG. 4, as viewed from another angle.
Figure 7:
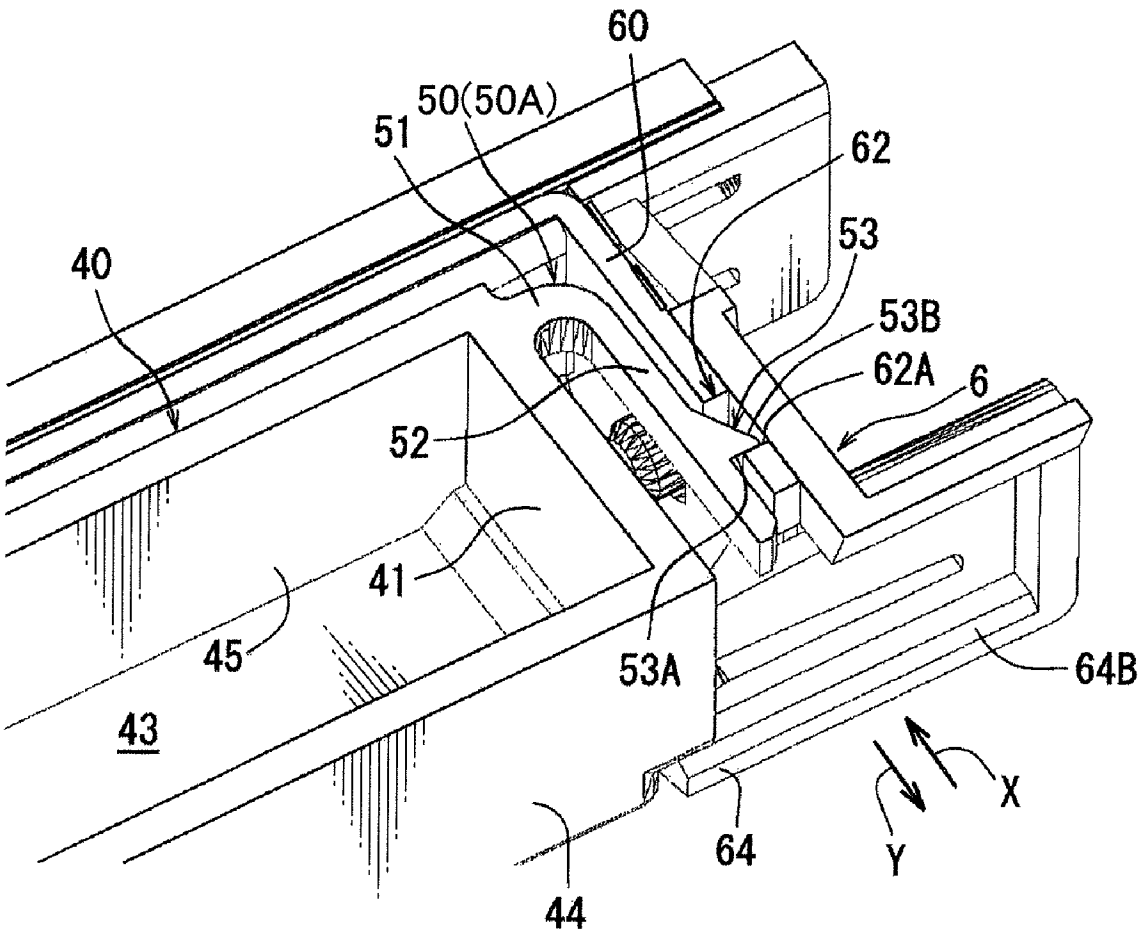
FIG. 7 is a cross-sectional perspective diagram showing the toner recovery tray in an installed state.
Figure 8:
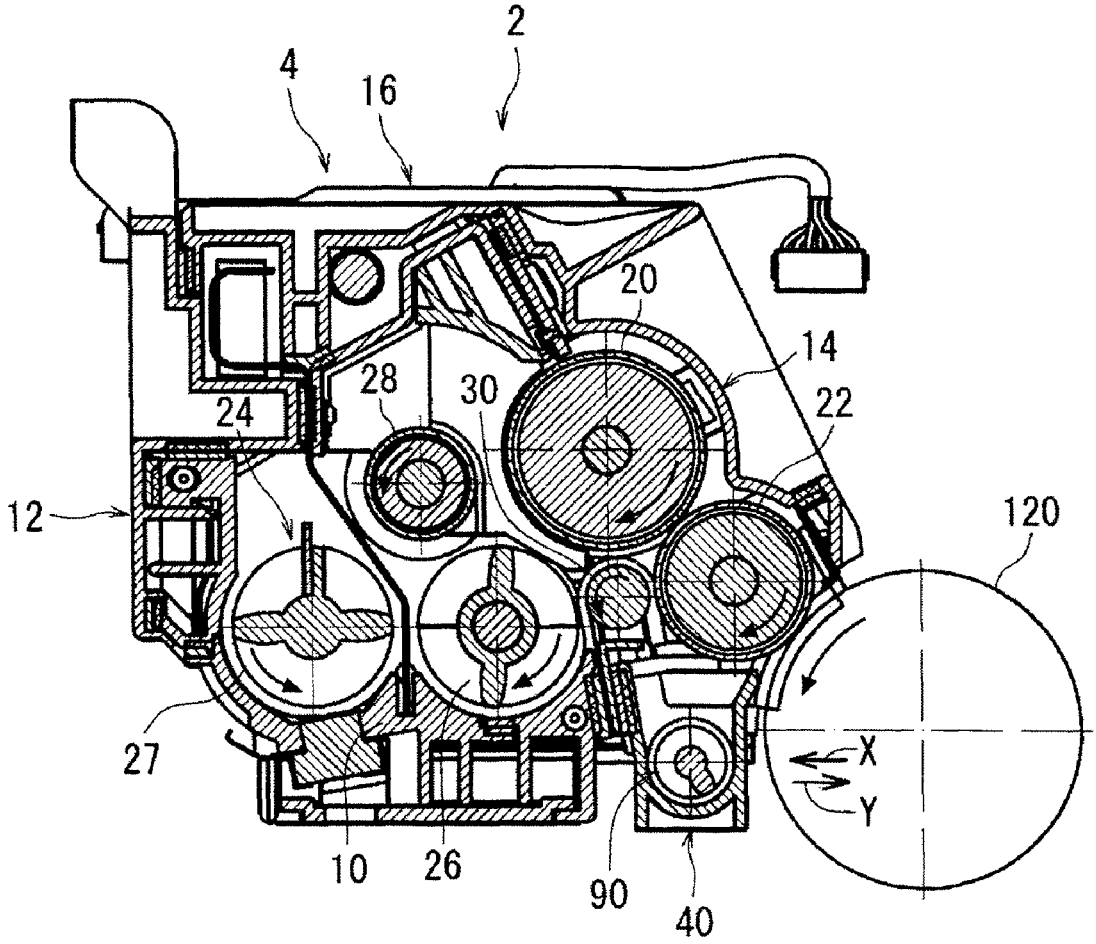
FIG. 8 is a cross-sectional diagram of a developing device relating to a further embodiment of the present invention.
Figure 9:
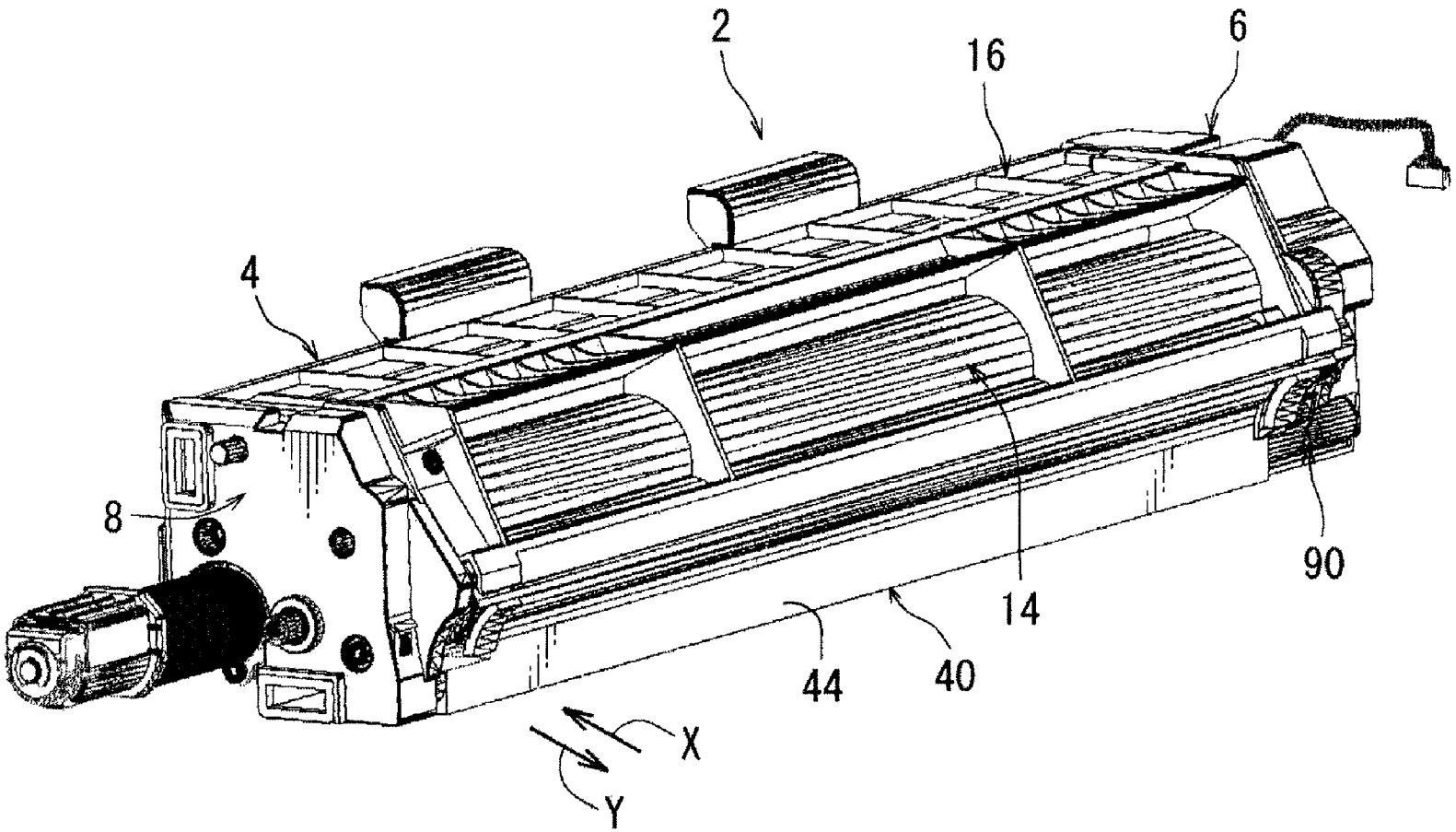
FIG. 9 is a perspective diagram of the developing device shown in FIG. 8.
Figure 10:
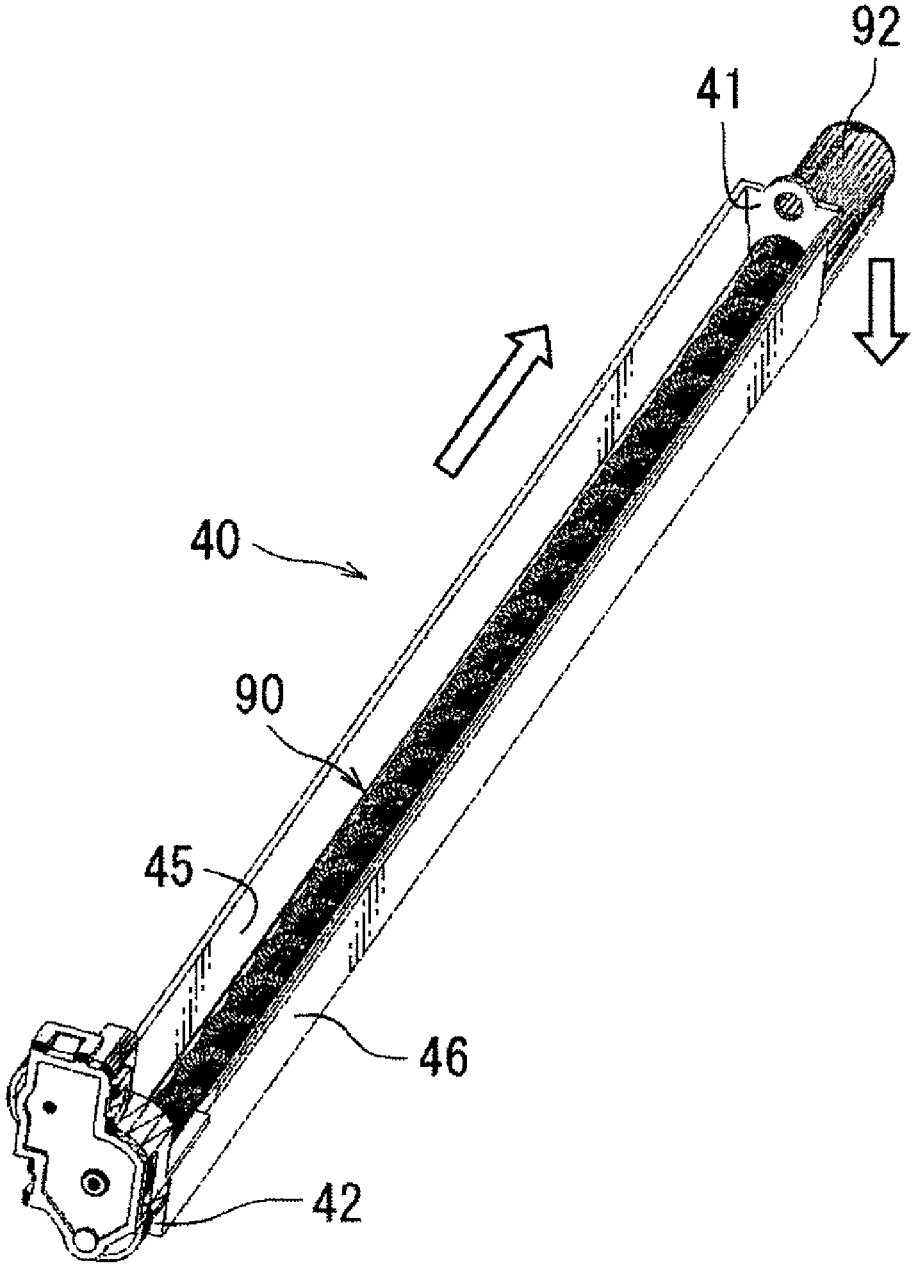
FIG. 10 is a perspective diagram of the toner recovery tray installed in the developing device relating to a further embodiment.
Figure 11:
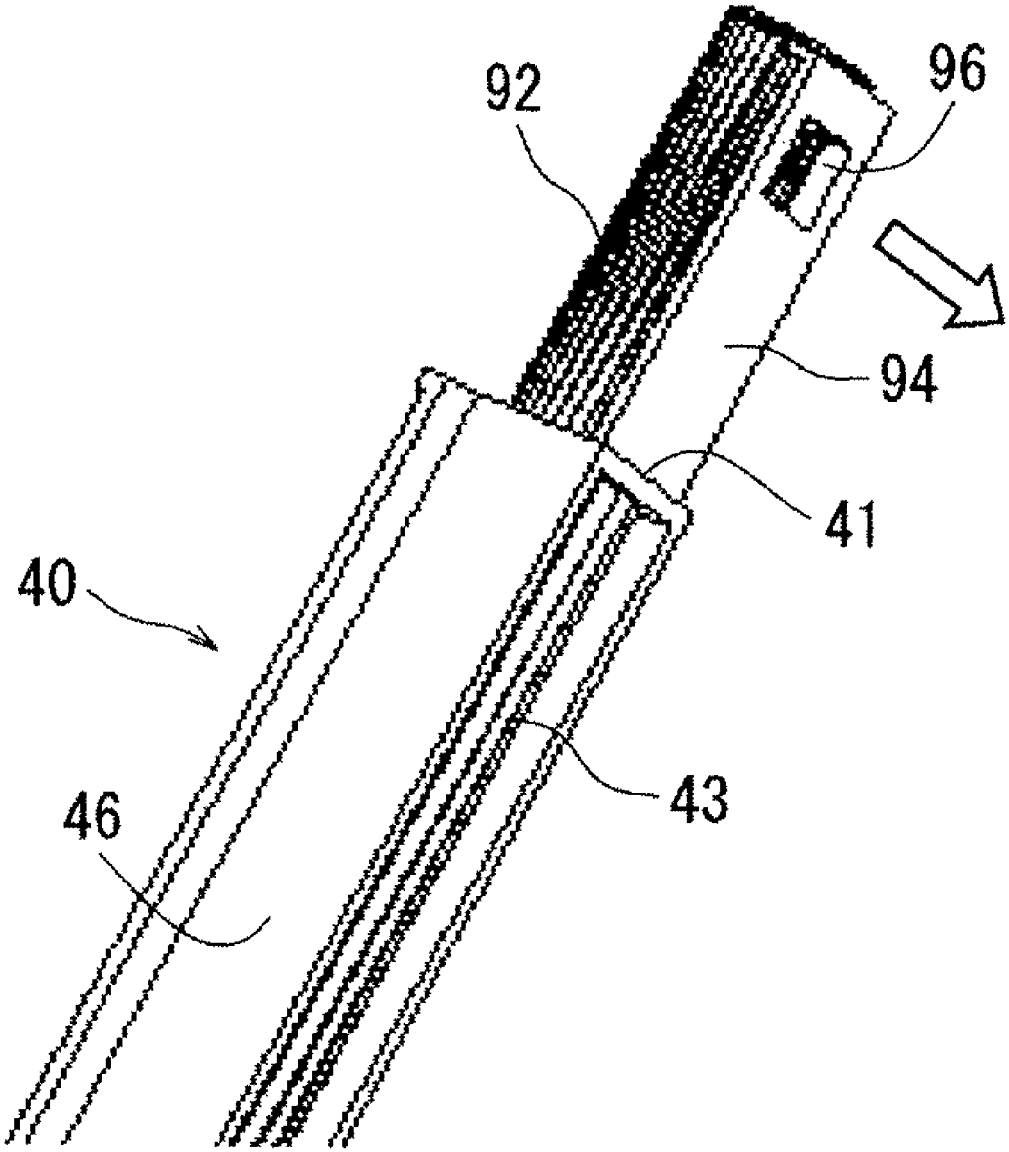
FIG. 11 is a partial enlarged perspective diagram of the toner recovery tray shown in FIG. 10, as viewed from the right-hand lower side.

The side wall 60 and the side wall which is not illustrated have supporting sections 64 extending by the same length in mutually approaching directions, from the respective lower ends thereof. In the embodiment, the respective supporting sections 64 are each assembled from the outer side on the side wall and the side wall which is not illustrated, and are both constituted by separate members to those constituting the first side wall 6 and the second side wall 8. Of the supporting sections 64 which have substantially the same shape and size as each other, only the one supporting section 64 provided on the side wall 60 is depicted in FIG. 4, FIG. 6 and FIG. 7. The respective upper surfaces 64A of the supporting sections 64 are located in the same plane at substantially the same height. An inclined surface 64B which is inclined downwards from the respective upper face 64A toward the removal direction Y, is formed on the front end on the removal direction Y side of each of the upper faces 64A.

The toner recovery tray 40 is inserted respectively between the side wall 60 and the side wall which is not illustrated, of the developing housing 4. In this inserting action, the first and second elastic engagement receiving hooks 50 of the toner recovery tray 40 deform elastically toward the inner side and then revert elastically to their original shapes inside the engaging holes 62 provided in the side wall 60 and the side wall which is not illustrated of the developing housing 4, and the toner recovery tray 40 is thereby engaged in a releasable state. Accordingly, the toner recovery tray 40 is installed detachably between the side wall 60 and the side wall that is not illustrated of the developing housing 4 (see FIG. 1, FIG. 2, FIG. 4 and FIG. 7).

When the first and second elastic engagement receiving hooks 50 have been engaged in the engaging holes 62 in the side wall 60 and the side wall that is not illustrated of the developing housing 4, the engagement receiving surface 53A of the engagement receiving section 53 of each of the first and second elastic engagement receiving hooks 50 is positioned so as to oppose the engaging surface 62A of the corresponding engaging hole 62. Consequently, even if the toner recovery tray 40 receives a force in the removal direction Y with respect to the developing housing 4, the respective engagement receiving surfaces 53A each abut against the engaging surface 62A of the corresponding engaging hole 62, thereby preventing detachment of the toner recovery tray 40. The inclined surfaces 53B of the respective engagement receiving sections 53 of the first and second elastic engagement receiving hooks 50 facilitate the engagement operation of the respective first and second elastic engagement receiving hooks 50 with the respective engaging holes 62.

When the toner recovery tray 40 is installed between the side wall 60 and the side wall that is not illustrated of the developing housing 4, the respective end portion bottom surfaces 43A of the bottom wall 43 are mounted slidably in the installation direction X and the removal direction Y on the upper surfaces 64A of the respective supporting sections 64 of the side wall 60 and the side wall that is not illustrated. Furthermore, the step sections 47 are respectively positioned in a relatively movable fashion in the installation direction X and the removal direction Y, on the inner side of the front end of the corresponding supporting section 64. In this state, the toner recovery tray 40 is inserted into the developing housing 4 and is installed and supported in this state. The respective inclined surfaces 64B of the upper surfaces 64A make the operation of installing the toner recovery tray 40 into the developing housing 4 smooth. A partial region of the surface of the developing roller 22 is exposed to the front side via the gap between the lower end of the front wall 14 and the upper end of the front side wall 44 of the toner recovery tray 40.

When seeking to remove the toner recovery tray 40 from the developing housing 4, firstly, the user causes the front end portions, on the side of the removal direction Y, of the main body sections 52 in each of the elastic engagement receiving hooks 50 of the toner recovery tray 40 respectively to deform elastically toward the outer surfaces of the first end wall 41 and the second end wall 42 of the toner recovery tray 40. Consequently, the respective engagement receiving sections 53 are detached toward the inner sides from the corresponding engaging holes 62, thereby releasing their engagement. Thereupon, in this state, the user is able to detach the toner recovery tray 40 toward the front of the developing housing 4, by pulling the tray out in the removal direction Y from the developing housing 4.

In this way, according to the developing device 2 relating to the present embodiment, the operations of installing and removing the toner recovery tray 40 with respect to the developing housing 4 can be carried out easily and reliably, and each involve virtually one-touch operations.

Next, the action of the developing device 2 will be described with reference to FIG. 1A. When the developing device 2 is installed in the image forming apparatus 100 (FIG. 12), the partial region of the surface of the developing roller 22 which is exposed to the front side is caused to oppose the surface of the photosensitive drum 120 at a prescribed gap from same. The photosensitive drum 120, and the magnetic roller 20 and developing roller 22, and other rotating members of the developing device 2 are driven to rotate in the directions indicated respectively by the arrows in FIG. 1A, by drive means which are not illustrated. Developer which has been agitated by the developer agitating and conveying members 26 and 27 inside the developer accommodating chamber 24 is taken up by the developer uptake roller 28 and supplied to the magnetic roller 20, and the developer is attracted to and held on the magnetic roller 20.

The developer attracted to and held on the surface of the magnetic roller 20 is restricted to a uniform layer thickness by the restricting member 29, and only the toner is supplied to the surface of the developing roller 22 in the position which opposes the developing roller 22. The toner which has become attached electrostatically to the surface of the developing roller 22 is supplied to the surface of the photosensitive drum 120, thereby developing the electrostatic latent image. As commonly known, bias voltages are applied to the developer uptake roller 28, the developing roller 22 and the magnetic roller 20 from respective bias power supply apparatuses which are not illustrated.

A bias voltage is also applied to the toner recovery roller 30 from a bias power source apparatus which is not illustrated, thereby electrostatically attracting the residual toner on the magnetic roller 20 and the developing roller 22 and causing same to adhere to the toner recovery roller 30. The toner which has adhered electrostatically to the toner recovery roller 30 is swept off and recovered into the developer accommodating chamber 24 by means of a blade member 32.

According to the developing device 2 relating to the present embodiment, the residual toner from the magnetic roller 20 and the developing roller 22 is recovered into the developer accommodating chamber 24 by the toner recovery roller 30. Furthermore, the uncharged toner which has been dispersed below the magnetic roller 20 and the developing roller 22, rather than being recovered by the toner recovery roller 30, falls down naturally inside the toner recovery tray 40 and is thereby recovered. As stated previously, since the toner recovery tray 40 can be installed readily and reliably with respect to the developing housing 4, and can be removed readily by a one-touch operation, then the tray can be replaced even if it becomes full before the end of the usable period of the developing device 2. Furthermore, the toner alone can be moved to a separate toner recovery vessel and the toner recovery tray 40 can be installed in the developing housing 4 against and reused easily.

FIG. 8 to FIG. 11 show a further embodiment of the developing device 2. In this embodiment, a toner conveyance screw (toner conveyance member) which conveys toner received in the toner recovery tray 40 is supported rotatably between the first end wall 41 and the second end wall 42 of the toner recovery tray 40. A tubular housing 92 which extends outwards in the lengthwise direction is formed on the first end wall 41, and one end portion of the toner conveyance screw 90 extends from inside the housing 92.

A toner discharge port 96 is formed in the bottom section 94 of the housing 92. By driving the toner conveyance screw 90 to rotate at a suitable timing, the toner recovered inside the toner recovery tray 40 is conveyed to the housing 92, and the toner conveyed to the housing 92 can be discharged from the toner discharge port 96 and recovered into the toner recovery vessel, which is not illustrated. The remaining composition is substantially the same as the foregoing embodiment which was described with reference to FIG. 1 to FIG. 7, and therefore the same portions are labelled with the same reference numerals and description thereof is omitted here.

In the embodiment described above, engaging recess sections or engaging holes 62 which constitute engaging sections are formed respectively in the side walls 60 of the developing housing 4, but instead of this, the engaging sections may also be composed by engaging projections (not illustrated). Referring to FIG. 7, the engaging projections of this kind can be composed, for example, by respectively providing an inclined surface extending toward the inner side in the installation direction X and an engaging surface extending from the front end of the inclined surface until the inner side surface, on the mutually opposing inner side surfaces of each side wall 60, at the positions on the inner side surfaces where the engaging holes 62 are formed. Similarly to the respective engaging surfaces 62A of the engaging holes 62, the respective engaging surfaces of the engaging projections are formed so as to face the installation direction X and extend to a prescribed height in the vertical direction perpendicular in the installation direction X, with a prescribed width in the horizontal direction perpendicular to the installation direction X.

According to the image forming apparatus 100 including a developing device 2 relating to the present embodiment, it is possible to prevent problems of soiling or impairment of normal operation and functions, due to toner leaking from the developing device 2 into the apparatus main body 102 and the toner adhering to and accumulating on the charging device 122, the LED head 124 and other devices, which are provided inside the apparatus main body 102. Furthermore, environmental contamination of the periphery of the image forming apparatus is also prevented.

The concrete embodiments described above principally comprise inventions having the compositions described below.

The developing device relating to one aspect of the present invention includes: a developing housing having a developer accommodating chamber; a developer bearing member which is supported rotatably inside the developing housing, and which holds, on a circumferential surface thereof, a two-component developer composed of a magnetic carrier and toner; a toner bearing member which is supported rotatably so as to oppose the developer bearing member inside the developing housing, and to which the toner in the developer held on the developer bearing member adheres electrostatically; and a toner recovery tray which has an opening in an upper end thereof, and which is installed removably in the developing housing below the developer bearing member and the toner bearing member.

According to this composition, even in the case of a layout where the developer accommodating chamber is not disposed substantially in a position directly below the positions where the developer bearing member (magnetic roller) and the toner bearing member (developing roller) are disposed, it is possible at least to recover dispersed toner from the developing roller and the magnetic roller, and the like.

Desirably, the composition described above further includes: a recovery member which is disposed above the opening of the toner recovery tray, and which recovers the toner from the developer bearing member and the toner bearing member; and an introducing member which guides the toner recovered by the recovery member into the developer accommodating chamber. According to this composition, some of the toner particles directed toward the toner recovery tray are recovered by the recovery member and are returned to the developer accommodating chamber by the introducing member, and therefore it is possible to utilize the toner efficiently.

In this case, desirably, the recovery member is a toner recovery roller which is disposed so as to oppose the developer bearing member and the toner bearing member via a gap, and to the circumferential surface of which the toner adheres electrostatically. According to this composition, it is possible readily to recover toner floating in the periphery of the developer bearing member and the toner bearing member.

Furthermore, desirably, the introducing member is a blade member which makes contact with the circumferential surface of the toner recovery roller and wipes off the toner adhering to the circumferential surface of the toner recovery roller, thereby causing the toner to fall toward the developer accommodating chamber. According to this composition, it is possible reliably to return the toner recovered by the toner recovery roller to the developer accommodating chamber.

In the composition described above, desirably, the toner recovery tray further has a toner conveyance member which conveys the toner that has been received in the toner recovery tray, and a toner discharge port which discharges, from the toner recovery tray, the toner conveyed by the toner conveyance member. According to this composition, since the toner is discharged from the toner discharge port, then the interior of the toner recovery tray does not fill up with recovered toner, and it is possible to reduce the work of replacing the toner recovery tray.

In this case, desirably, the toner recovery tray includes a first end wall and a second end wall opposing the first end wall; the toner conveyance member is a toner conveyance screw, the respective ends of which are supported rotatably by the first end wall and the second end wall; the toner conveyance screw conveys the toner from a second end wall side toward a first end wall side; and the toner discharge port is disposed on the first end wall side. By means of this composition, it is possible to guide toner to the toner discharge port simply by rotating the toner conveyance screw.

Desirably, in the composition described above, the toner recovery tray includes a first end wall and a second end wall opposing the first end wall; the developing housing has a first side wall and a second side wall which are mutually opposing via a gap in the axial direction of the developer bearing member and the toner bearing member, at a position below the developer bearing member and the toner bearing member; and in a state where the toner recovery tray has been installed in the developing housing, the first end wall of the toner recovery tray engages with the first side wall of the developing housing and the second end wall engages with the second side wall. According to this composition, it is possible to achieve easy installation of the toner recovery tray, in a mode where the toner recovery tray is gripped between the mutually opposing first side wall and second side wall of the developing housing.

In this case, desirably, a first engaging section and a second engaging section are formed in the first side wall and the second side wall respectively; a first elastic engagement receiving hook and a second elastic engagement receiving hook are disposed on outer surfaces of the first end wall and the second end wall respectively; and in a state where the toner recovery tray has been installed in the developing housing, the first elastic engagement receiving hook and the second engagement receiving hook of the toner recovery tray respectively engage releasably with the first engaging section and the second engaging section of the developing housing. According to this composition, it is possible to install the toner recovery tray in the developing housing by using the elastic force of the first and second elastic engagement receiving hooks.

Moreover, desirably, the first engaging section and the second engaging section of the developing housing respectively has engaging surfaces following a direction of insertion of the toner recovery tray with respect to the developing housing; the first elastic engagement receiving hook and the second elastic engagement receiving hook of the toner recovery tray respectively has: a base end section which extends outwards from an outer surface of the first end wall or the second end wall; a main body section which extends in the reverse of the insertion direction from a front end of the base end section, at an interval from the outer surface of the first end wall or the second end wall; and an engagement receiving section which projects outwards from the outer surface of the main body section; the engagement receiving sections each have an engaging surface extending perpendicularly outwards from the main body section and an inclined surface extending from the front end of the engaging surface to the outer surface of the main body section in the insertion direction; and the engagement receiving surfaces are positioned so as to oppose the engaging surfaces in a state where the first elastic engagement receiving hook and the second elastic engagement receiving hook have been engaged with the first engaging section and the second engaging section respectively. According to this composition, it is possible to install the toner recovery tray more readily and reliably.

Moreover, desirably, the developing housing has supporting sections which extend in mutually approaching directions from respective lower ends of the first side wall and the second side wall; the toner recovery tray has a bottom wall extending between the first end wall and the second end wall, and side walls extending upwards from either side of the bottom wall, the respective ends of the side walls in the axial direction being connected respectively to the first end wall and the second end wall; bottom surface portions of the bottom wall of the toner recovery tray in either end portion in the axial direction are respectively formed so as to be situated, via a step section, in a position higher than the bottom surface in an intermediate portion in the axial direction; and in a state where the toner recovery tray has been installed in the developing housing, the toner recovery tray is supported, with the bottom surface portions of the bottom wall in either end portion being situated on the supporting sections of the developing housing, and respective step sections being positioned on an inner side of the front end of the corresponding supporting section. According to this composition, it is possible to stabilise the state of installation of the toner recovery tray onto the developing housing.

Furthermore, the image forming apparatus relating to a further aspect of the present invention is an image forming apparatus including: an image bearing member; and a developing device which supplies toner to the image bearing member; wherein the developing device has the composition described above.

According to an image forming apparatus of this kind, it is possible to prevent soiling or impairment of normal operation and functioning, due to the adherence or accumulation of toner on the charging device, exposure device and other devices provided inside the apparatus. Furthermore, toner contamination of the periphery of the image forming apparatus is also prevented.

This application is based on Japanese Patent application serial No. 2009-130577 filed in Japan Patent Office on May 29, 2009, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A developing device, comprising:

a developing housing having a developer accommodating chamber;

a developer bearing member which is supported rotatably inside the developing housing, and which holds, on a circumferential surface thereof, a two-component developer composed of a magnetic carrier and toner;

a toner bearing member which is supported rotatably so as to oppose the developer bearing member in the developing housing, and to which the toner in the developer held on the developer bearing member adheres electrostatically; and a toner recovery tray which has an opening in the upper end thereof, and which is installed removably in the developing housing below the developer bearing member and the toner bearing member.

2. The developing device according to claim 1, further comprising:

a recovery member which is disposed above the opening of the toner recovery tray, and which recovers the toner from the developer bearing member and the toner bearing member; and an introducing member which guides the toner recovered by the recovery member into the developer accommodating chamber.

3. The developing device according to claim 2, wherein the recovery member is a toner recovery roller which is disposed so as to oppose the developer bearing member and the toner bearing member via a gap, and to the circumferential surface of which the toner adheres electrostatically.

4. The developing device according to claim 3, wherein the introducing member is a blade member which makes contact with the circumferential surface of the toner recovery roller and wipes off the toner adhering to the circumferential surface of the toner recovery roller, thereby causing the toner to fall toward the developer accommodating chamber.

5. The developing device according to claim 1, wherein the toner recovery tray includes:

a toner conveyance member which conveys the toner that has been received in the toner recovery tray; and a toner discharge port which discharges, from the toner recovery tray, the toner conveyed by the toner conveyance member.

6. The developing device according to claim 5, wherein the toner recovery tray includes a first end wall and a second end wall opposing the first end wall;

the toner conveyance member is a toner conveyance screw, the respective ends of which are supported rotatably by the first end wall and the second end wall;

the toner conveyance screw conveys the toner from a second end wall side toward a first end wall side; and the toner discharge port is disposed on the first end wall side.

7. The developing device according to claim 1, wherein the toner recovery tray includes a first end wall and a second end wall opposing the first end wall, the developing housing has a first side wall and a second side wall which are mutually opposing via a gap in the axial direction of the developer bearing member and the toner bearing member, at a position below the developer bearing member and the toner bearing member, and in a state where the toner recovery tray has been installed in the developing housing, the first end wall of the toner recovery tray engages with the first side wall of the developing housing and the second end wall engages with the second side wall.

8. The developing device according to claim 7, wherein a first engaging section and a second engaging section are formed in the first side wall and the second side wall respectively, a first elastic engagement receiving hook and a second elastic engagement receiving hook are disposed on outer surfaces of the first end wall and the second end wall respectively, and in a state where the toner recovery tray has been installed in the developing housing, the first elastic engagement receiving hook and the second engagement receiving hook of the toner recovery tray respectively engage releasably with the first engaging section and the second engaging section of the developing housing.

9. The developing device according to claim 8, wherein the first engaging section and the second engaging section of the developing housing respectively have engaging surfaces following a direction of insertion of the toner recovery tray with respect to the developing housing, the first elastic engagement receiving hook and the second elastic engagement receiving hook of the toner recovery tray respectively have: a base end section which extends outwards from an outer surface of the first end wall or the second end wall; a main body section which extends in the reverse of the insertion direction from a front end of the base end section, at an interval from the outer surface of the first end wall or the second end wall; and an engagement receiving section which projects outwards from the outer surface of the main body section, the engagement receiving sections each have an engaging surface extending perpendicularly outwards from the main body section and an inclined surface extending from the front end of the engaging surface to the outer surface of the main body section in the insertion direction, and the engagement receiving surfaces are positioned so as to oppose the engaging surfaces in a state where the first elastic engagement receiving hook and the second elastic engagement receiving hook have been engaged with the first engaging section and the second engaging section respectively.

10. The developing device according to claim 8, wherein the developing housing has supporting sections which extend in mutually approaching directions from respective lower ends of the first side wall and the second side wall, the toner recovery tray has a bottom wall extending between the first end wall and the second end wall, and side walls extending upwards from either side of the bottom wall, the respective ends of the side walls in the axial direction being connected respectively to the first end wall and the second end wall, bottom surface portions of the bottom wall of the toner recovery tray in either end portion in the axial direction are respectively formed so as to be situated, via a step section, in a position higher than the bottom surface in an intermediate portion in the axial direction, and in a state where the toner recovery tray has been installed in the developing housing, the toner recovery tray is supported, with the bottom surface portions of the bottom wall in either end portion being situated on the supporting sections of the developing housing, and respective step sections being positioned on an inner side of the front end of the corresponding supporting section.

11. An image forming apparatus, comprising:

an image bearing member; and a developing device which supplies toner to the image bearing member, wherein the developing device includes:

a developing housing having a developer accommodating chamber;

a developer bearing member which is supported rotatably inside the developing housing, and which holds on a circumferential surface thereof a two-component developer composed of a magnetic carrier and toner;

a toner bearing member which is supported rotatably so as to oppose the developer bearing member inside the developing housing, and to which the toner in the developer held on the developer bearing member adheres electrostatically; and a toner recovery tray which has an opening in the upper end thereof, and which is installed removably in the developing housing below the developer bearing member and the toner bearing member.

12. The image forming apparatus according to claim 11, further comprising:

a recovery member which is disposed above the opening of the toner recovery tray, and which recovers the toner from the developer bearing member and the toner bearing member; and an introducing member which guides the toner recovered by the recovery member into the developer accommodating chamber.

13. The image forming apparatus according to claim 12, wherein the recovery member is a toner recovery roller, disposed so as to oppose the developer bearing member and the toner bearing member via a gap, and to the circumferential surface of which the toner adheres electrostatically.

14. The image forming apparatus according to claim 13, wherein the introducing member is a blade member which makes contact with the circumferential surface of the toner recovery roller and wipes off the toner adhering to the circumferential surface of the toner recovery roller, thereby causing the toner to fall toward the developer accommodating chamber.

15. The image forming apparatus according to claim 11, wherein the toner recovery tray includes:

a toner conveyance member which conveys the toner that has been received in the toner recovery tray; and a toner discharge port which discharges, from the toner recovery tray, the toner conveyed by the toner conveyance member.

16. The image forming apparatus according to claim 15, wherein the toner recovery tray includes a first end wall and a second end wall opposing the first end wall, the toner conveyance member is a toner conveyance screw, the respective ends of which are supported rotatably by the first end wall and the second end wall;

the toner conveyance screw conveys the toner from a second end wall side toward a first end wall side; and the toner discharge port is disposed on the first end wall side.

17. The image forming apparatus according to claim 11, wherein the toner recovery tray includes a first end wall and a second end wall opposing the first end wall, the developing housing has a first side wall and a second side wall which are mutually opposing via a gap in an axial direction of the developer bearing member and the toner bearing member, at a position below the developer bearing member and the toner bearing member, and in a state where the toner recovery tray has been installed in the developing housing, the first end wall of the toner recovery tray engages with the first side wall of the developing housing and the second end wall engages with the second side wall.

18. The image forming apparatus according to claim 17, wherein a first engaging section and a second engaging section are formed in the first side wall and the second side wall respectively, a first elastic engagement receiving hook and a second elastic engagement receiving hook are disposed on outer surfaces of the first end wall and the second end wall respectively, and in a state where the toner recovery tray has been installed in the developing housing, the first elastic engagement receiving hook and the second engagement receiving hook of the toner recovery tray respectively engage releasably with the first engaging section and the second engaging section of the developing housing.

19. The image forming apparatus according to claim 18, wherein the first engaging section and the second engaging section of the developing housing respectively have engaging surfaces following a direction of insertion of the toner recovery tray with respect to the developing housing, the first elastic engagement receiving hook and the second elastic engagement receiving hook of the toner recovery tray respectively have: a base end section which extends outwards from the outer surface of the first end wall or the second end wall; a main body section which extends in the reverse of the insertion direction from a front end of the base end section, at an interval from the outer surface of the first end wall or the second end wall; and an engagement receiving section which projects outwards from the outer surface of the main body section, the engagement receiving sections each have an engaging surface extending perpendicularly outwards from the main body section and an inclined surface extending from the front end of the engaging surface to the outer surface of the main body section in the insertion direction, and the engagement receiving surfaces are positioned so as to oppose the engaging surfaces in a state where the first elastic engagement receiving hook and the second elastic engagement receiving hook have been engaged with the first engaging section and the second engaging section respectively.

20. The image forming apparatus according to claim 18, wherein the developing housing has supporting sections which extend in mutually approaching directions from respective lower ends of the first side wall and the second side wall, the toner recovery tray has a bottom wall extending between the first end wall and the second end wall, and side walls extending upwards from either side of the bottom wall, the respective ends of the side walls in the axial direction being connected respectively to the first end wall and the second end wall, bottom surface portions of the bottom wall of the toner recovery tray in either end portion in the axial direction are respectively formed so as to be situated, via a step section, in a position higher than the bottom surface in an intermediate portion in the axial direction, and in a state where the toner recovery tray has been installed in the developing housing, the toner recovery tray is supported, with the bottom surface portions of the bottom wall in either end portion being situated on the supporting sections of the developing housing, and respective step sections being positioned on an inner side of the front end of the corresponding supporting section.

* * * * *